United States Patent [19]

Jacobs, Jr.

[11] 4,020,441

[45] Apr. 26, 1977

[54] ELECTRIC FUSE HAVING UNDULATED FUSIBLE ELEMENT

[75] Inventor: Philip C. Jacobs, Jr., Newtonville, Mass.

[73] Assignee: Gould Inc. Electric Fuse Division, Mass.

[22] Filed: Mar. 5, 1976

[21] Appl. No.: 664,104

[52] U.S. Cl. ..... 337/187; 337/159; 337/295

[51] Int. Cl.² ..... H01H 85/08

[58] Field of Search ..... 337/159, 187, 276, 290, 337/295

[56] References Cited

UNITED STATES PATENTS

| | | | |
|---|---|---|---|
| 3,648,210 | 3/1972 | Kozacka | 337/295 |
| 3,742,415 | 6/1973 | Cameron et al. | 337/159 |
| 3,913,050 | 10/1975 | Mikulecky | 337/159 |

FOREIGN PATENTS OR APPLICATIONS

| | | | |
|---|---|---|---|
| 2,339,400 | 2/1975 | Germany | 337/159 |

*Primary Examiner*—Gerald Goldberg
*Attorney, Agent, or Firm*—Erwin Salzer

[57] ABSTRACT

An electric fuse has an undulated fusible element provided with a plurality of aligned, spaced perforations. A straight rod preferably of a gas-evolving material extends through said plurality of perforations. The rod increases significantly the dimensional stability of the fusible element structure and contributes at the same time significantly to arc-extinction, if made of a gas-evolving material.

5 Claims, 4 Drawing Figures

ELECTRIC FUSE HAVING UNDULATED FUSIBLE ELEMENT

BACKGROUND OF THE INVENTION

Fuses for elevated circuit voltages require often fusible elements whose length exceeds that of the casing or fuse tube. These are two widely used ways of complying with this requirement. One of them consists in imparting an undulating shape, and the other consists in imparting a helical shape, to the fusible element. When deciding on the helical configuration for the fusible element, the latter is generally wound around a heat resistant insulating support or mandrel. Fusible elements which have an undulating shape are generally not provided with insulating supports. Unsupported fusible elements whose shape is undulating are generally only applied for relatively short fuses, or fuses intended to have a relatively limited voltage rating, e.g. a few kilovolts. The absence of any support for undulating fusible elements gives rise to the danger that the elements will be distorted by the impact of the granular arc-quenching filler when the latter is filled into the casing. To avoid or minimize this danger it is common practice to increase as much as possible the dimensional stability of unsupported undulating fusible elements by imparting a relatively considerable thickness to them. This, however, results in a relatively small area of interface between the surface of the fusible element and that of its surrounding granular arc-quenching medium. In order to optimize the cooling action of the granular arc-quenching medium upon the metal vapors resulting from vaporization of the fusible element, the aforementioned interface should be as large as possible, and the thickness of the fusible element ought, therefore, to be as small as possible.

It is the prime object of this invention to provide electric fuses having undulated fusible elements which are not subject to the aforementioned limitations.

Other objects of the invention will become apparent as this specification proceeds.

SUMMARY OF THE INVENTION

Fuses embodying this invention have an undulated fusible element inside the casing thereof. The fusible element conductively interconnects the terminal elements of the fuse and is embedded in a granular arc-quenching filler inside the casing. The fusible element has a plurality of spaced aligned perforations. Fuses embodying this invention further include a straight rod of an electric insulating material. The rod extends through said plurality of aligned perforations of said fusible element.

DESCRIPTION OF PREFERRED EMBODIMENTS

Figure 1:
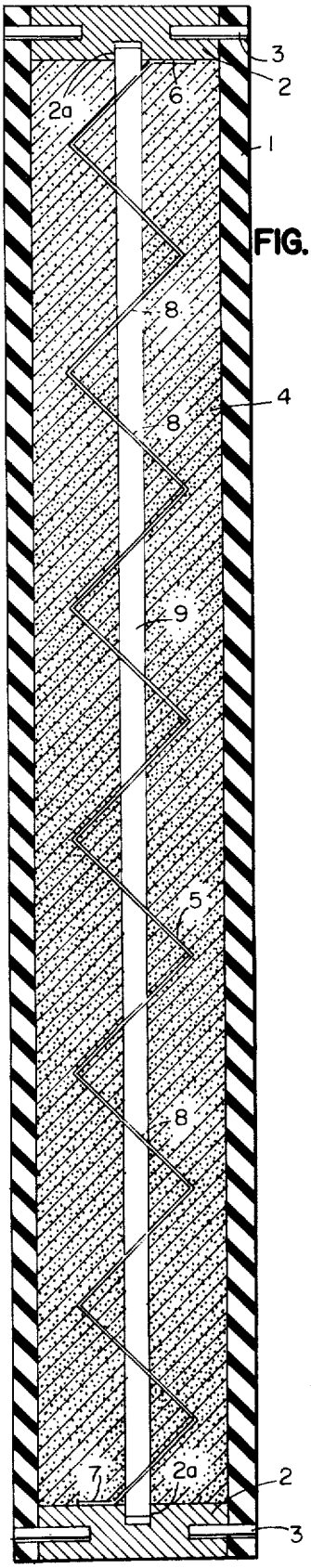
FIG. 1 is substantially a longitudinal section of a fuse embodying this invention.
Figure 2:
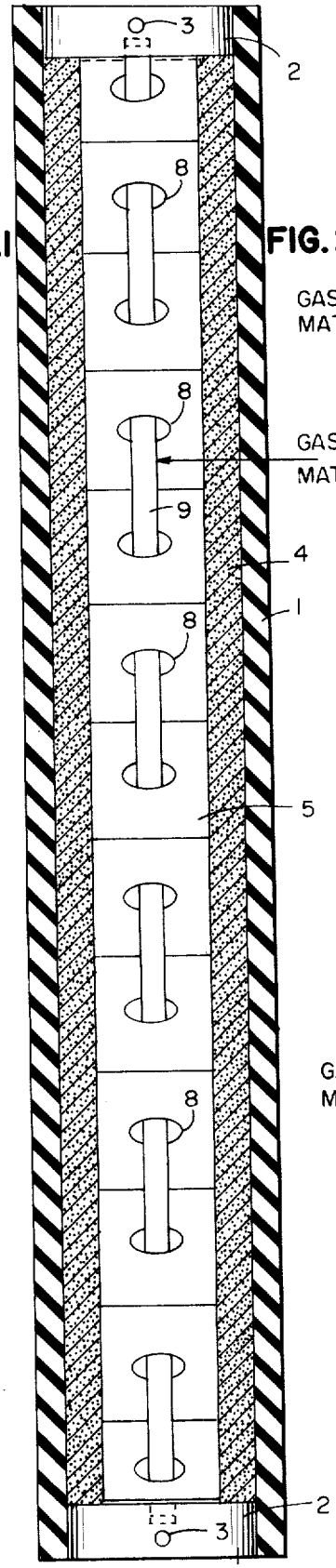
FIG. 2 is substantially a longitudinal section of the fuse shown in FIG. 1 taken along a plane at right angles to that of FIG. 1 and showing some parts of the fuse in elevation rather than sectionalized.

Referring now to FIGS. 1 and 2, numeral 1 has been applied to indicate a tubular casing, preferably of a synthetic-resin-glass-cloth laminate. A pair of terminal elements 2 is arranged at the ends of casing 1 and close the same. Terminal elements 2 are formed by metal plugs press-fitted into the ends of the casing 1 and pinned by casing 1 by steel pins 3, projecting radially through casing 1 into plugs 2. Casing 1 is filled with a granular arc-quenching filler 4, preferably quartz-sand. Reference numeral 5 has been applied to indicate an undulating fusible element, preferably in the form of a ribbon of sheet silver. Fusible element 5 is conductively connected at 6 and 7 to terminal elements 2, 2 and thus conductively interconnects the aforementioned terminal elements. Arc-quenching filler 4 embeds fusible element 5. Fusible element 5 is provided with a plurality of spaced aligned perforations 8. To be more specific, perforations 8 are aligned along an axis coextensive with the longitudinal axis of casing 1. Numeral 9 has been applied to indicate a straight rod of an electric insulating material. This material is preferably, but not necessarily, a material that evolves a gaseous medium when subjected to the heat of an arc. Such materials are well knwon in the art. One type of materials that is particularly suited for the purpose in hand are compounds made up of melamine resins, inorganic fillers, and anti-tracking substances. Rod 9 extends through the perforations 8 in fusible element 5 and has ends which project into recesses 2*a* in terminal elements or terminal plugs 2. There is a clearance left between the ends of rod 9 and the bottom of each recess 2*a*. Therefore rod 9 is free to elongate when heated. If desired, recesses 2*a* may be filled, in part, with a heat resistant elastomer, such as silicone rubber, allowing likewise elongation of rod 9 when heated. Perforations 8 in fusible element 5 are circular and have a predetermined diameter. Rod 9 is cylindrical and has a circular cross-section whose diameter is smaller than the diameter of perforations 8. This has been shown in an exaggerated fashion in FIG. 2. The undulary character of fusible element 5 tends to minimize thermal stresses and consequent fatigue failures of the fusible element. The aforementioned difference in diameters or loose fit of fusible element 5 on rod 9 facilitates independent movement of both parts when changing their configuration and length, respectively, on account of changes in temperature resulting from changes of ambient temperature and changes of the load current which the fuse is carrying.

Figure 3:
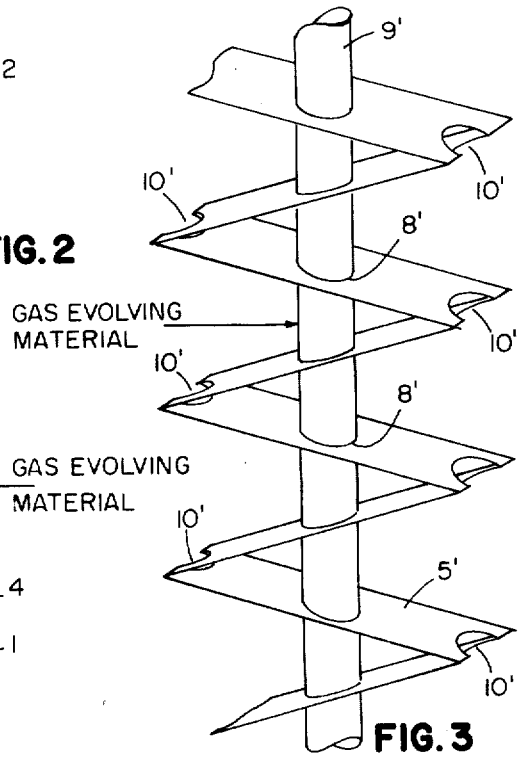
FIG. 3 is an isometric view of a modified detail of the structure of FIGS. 1 and 2.

The performance characteristics of fuses embodying this invention are largely determined by the geometry of the fusible element 5. Assuming the latter to be of uniform width and thickness, and further assuming that the only points of reduced cross-sectional area are the points along the fusible element 5 where its rod-receiving perforations 8 are located. In that instance the points of arc inception are located immediately adjacent to rod 9. Since the arc voltage tends to decrease with time at the points of arc inception, the arc extinguishing gases evolved from rod 9 tend to counteract this decrease of arc voltage. This is a function of support or rod 9 in addition to that of bracing fusible element 5. Referring now to FIG. 3, its fusible element 5′ corresponds to fusible element 5 of FIGS. 1 and 2, the perforations 8′ in element 5′ correspond to the perforations 8 in element 5 of FIGS. 1 and 2, and the rod 9′ corresponds to rod 9 of FIGS. 1 and 2. As shown in FIG. 3, fusible element 5' has additional perforations 10' at the points thereof where a change of direction or a bent occurs.

Proceeding on the assumption that perforations 8' and 10' are both circular and have the same diameter, this yields the following results. A sharp bent in a fusible element, such as the bents across perforations 10', tends to have the same effect on the melting $i^2 \cdot t$ as a slight reduction of cross-sectional area, i.e. a slight reduction of the melting $i^2 \cdot t$. In other words, melting will occur slightly sooner at the points of reduced cross-sectional area at perforations 10' than at the points of reduced sectional area at perforations 8'. At the first mentioned points there is a strong electrodynamic blow-out action due to the sharp bent in the current path. This blow-out action tends to effect a removal of liquefied metal from, and formation of breaks at, perforations 10', while the metallic current path adjacent perforations 8' is still intact. The breaks formed at perforations 8' are formed an increment of time following formation of breaks at perforations 10'. Thus the structure of FIG. 3 tends to result in sequential formation of two sets of breaks with attendent limitation of voltage surges. After inception of arcs adjacent perforations 8' the evolution of gas from rod 9' tends to stabilize the arc voltage as set forth above in connection with FIGS. 1 and 2.

Figure 4:
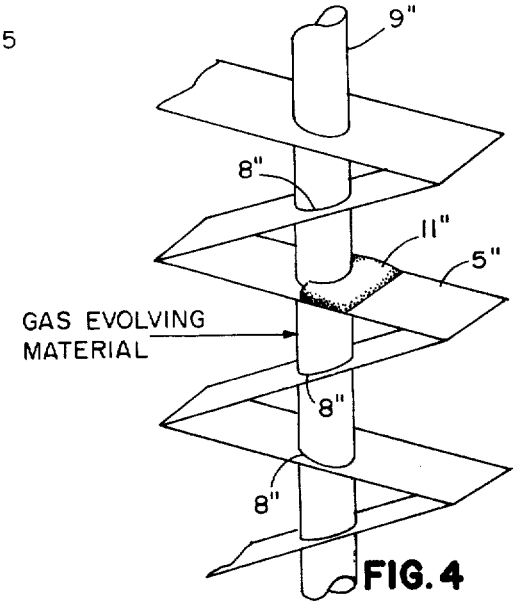
FIG. 4 is an isometric view of another modified detail of the structure of FIGS. 1 and 2.

Referring now to FIG. 4, its fusible element 5'' corresponds to the fusible element 5 of FIGS. 1 and 2, the perforations 8'' correspond to the perforations 8 of FIGS. 1 and 2, and the rod 9'' corresponds to the rod 9 of FIGS. 1 and 2. Fusible element 5'' has an overlay 11'' of a low fusing point metal capable of severing fusible element 5'' by a metallurgical reaction. Assuming fusible element 5'' is of silver, overlay 11'' may be of tin. Overlay 11'' is arranged immediately adjacent to a point where rod 9'' projects through one of perforations 8''.

Overlay 11'' causes formation of a break on occurrence of small protracted overloads. The overload current is too small to cause burnback of fusible element 5'' at such a speed as to generate an arc voltage sufficiently high to effect an interruption of the overloaded circuit. The arc-extinguishing gas evolved from rod 9'' boosts the arc voltage to the level required to interrupt the overloaded circuit.

The term undulated as used in this context is not limited to a zig-zag configuration of the fusible element as shown in FIGS. 1–4. It includes also more or less sinusoidal, trapeze-shaped or meandering configurations of fusible elements.

It is also possible to apply the present invention to fuses having several undulated or zig-zag shaped fusible elements connected in parallel such as, for instance, fuses of the type shown in U.S. Pat. No. 3,648,210 to Frederick J. Kozacka; 03/07/72 for *HIGH-VOLTAGE FUSE WITH SELF-SUPPORTING FUSE LINK.*

The rods 9, 9' and 9'', respectively, need not to extend all the way from one terminal element 2 to the other terminal element 2; they may be used to brace merely a portion of the total lengths of the fusible element. The structure shown in FIGS. 1 and 2 may be modified by sectionalizing rod 9 into two sections leaving a gap therebetween, one of these sections being affixed with one of its ends to the upper plug 2 and the other of these sections being affixed with one of its ends to the lower plug 2.

I claim as my invention:

1. An electric fuse including a. a tubular casing of electric insulating material;

b. a pair of terminal elements arranged at the ends of and closing said casing;

c. a granular arc-quenching filler inside of said casing;

d. an undulated fusible element inside said casing, conductively interconnecting said pair of terminal elements and embedded in said filler, said fusible element having a plurality of spaced aligned perforations, and e. a straight rod of an electric insulating material extending through said plurality of aligned perforations.

2. An electric fuse as specified in claim 1 wherein said rod is of an insulating material evolving an arc-extinguishing gaseous medium when subjected to the heat of an arc.

3. An electric fuse as specified in claim 1 wherein said plurality of perforations are circular having a predetermined diameter, and wherein said rod is cylindrical and has a circular cross-section having a diameter smaller than said predetermined diameter.

4. An electric fuse as specified in claim 2 wherein said fusible element has additional perforations at the points thereof where a change of directions occurs.

5. An electric fuse as specified in claim 2 wherein said fusible element has an overlay of a low fusing point metal capable of severing said fusible element by metallurgical reaction, said overlay being arranged immediately adjacent to a point where said rod projects through one of said plurality of perforations.

* * * * *